United States Patent [19]

Grisley

[11] 4,428,408

[45] Jan. 31, 1984

[54] DOVETAILING JIG

[76] Inventor: Kenneth M. Grisley, 238 Bouchie St., Quesnel, British Columbia, Canada, V2J, 1L8

[21] Appl. No.: 308,496

[22] Filed: Oct. 5, 1981

[51] Int. Cl.[3] ..... B27F 1/14

[52] U.S. Cl. ..... 144/144.5 R; 144/87; 144/371; 409/130

[58] Field of Search ..... 144/87, 85, 90 R, 90 A, 144/144 R, 144.5, 363, 371; 409/130

[56] References Cited

U.S. PATENT DOCUMENTS

| | | |
|---|---|---|
| 1,651,510 | 12/1967 | Carter . |
| 2,764,191 | 9/1956 | Hartmann . |
| 3,109,466 | 11/1963 | Jones . |
| 3,800,840 | 4/1974 | McCord . |
| 3,834,435 | 9/1974 | McCord . |
| 3,878,875 | 4/1975 | McCord . |
| 4,163,465 | 8/1979 | Strong . |
| 4,168,730 | 9/1979 | Keller . |

FOREIGN PATENT DOCUMENTS

| | | | |
|---|---|---|---|
| 637415 | 2/1962 | Canada | 144/87 |

*Primary Examiner*—W. D. Bray

*Attorney, Agent, or Firm*—Fulwider, Patton, Rieber, Lee & Utecht

[57] ABSTRACT

A jig used to support and guide a cutting tool has a base frame provided with an elongated support. Mounted on this support is a plurality of guide fingers which collectively serve as a template for the cutting of joint members in boards. The guide fingers are individually secured to the support so that the lateral spacing between the fingers is adjustable. Along one side edge of the support, the overhanging ends of the fingers are shaped to allow the cutting of common joint members. Along the other side edge of the support, the overhanging ends of the fingers are shaped to allow the cutting of complementary joint members. The jig has a clamping arrangement which allows the boards to be clamped to the base frame with the board ends disposed in selected positions relative to the shaped ends of the fingers. By suitable adjustment of the guide fingers, it is possible to provide the board with joint members of varying size and spacing as is sometimes desirable although the fingers can just as readily be arranged to produce joint members of uniform size and regular spacing.

14 Claims, 14 Drawing Figures

DOVETAILING JIG

BACKGROUND OF THE INVENTION

This invention relates to a device for holding and guiding a power tool used to cut joint members in a workpiece.

A well known method often used to provide boards with interconnecting joint members is to employ a template which serves as a guide for the cutting tool. For example, a dovetail jig usually is provided with a template which comprises an elongated plate having a plurality of longitudinally-spaced slots. The slots are shaped to guide a router fitted with a cutter bit capable of removing appropriate portions of the wood whereby the end edges of the boards are left with the dovetails and the pins of a conventional dovetail joint. Since such a template has slots of a predetermined width and center to center spacing, the resulting pins and dovetails are of a uniform size and little choice is offered as to how the joint members are arranged between the end edges of the boards.

SUMMARY OF THE INVENTION

The present invention provides an improved jig construction employing a number of guide fingers capable of being assembled and arranged to allow the cutting of dovetails or other joint members which are not necessarily of uniform size and which can vary in their spacing along the edge of a board. Once a setting has been selected for the dovetails which are to be cut in one board, pins can be cut in another board clamped to the jig which will accurately interlace with the dovetails cut in the first board.

DESCRIPTION OF THE PREFERRED EMBODIMENTS

Figure 1:
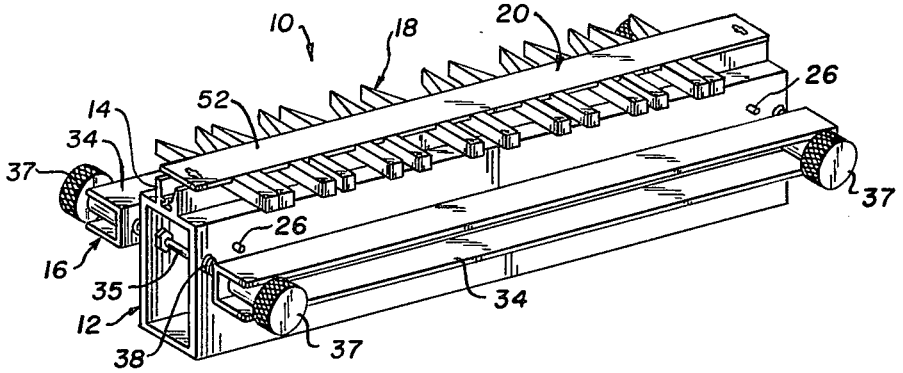
FIG. 1 is a perspective view of a dovetailing jig constructed in accordance with a preferred embodiment of the present invention.

Referring to the drawings, the numeral 10 indicates generally a dovetailing jig constructed in accordance with a preferred embodiment of the present invention. The complete jig 10 is shown in FIG. 1 as comprising an elongated base frame 12 having a longitudinally extending support 14. Clamping means 16 is provided on the base frame to hold boards or other workpieces in the required cutting position. The cutting is done by a conventional power tool which is supported and guided by a plurality of fingers 18 spaced along the support. These guide fingers are secured in their longitudinally spaced apart positions on the support by securing means 20.

The base frame generally indicated at 12 is shown in greater detail in FIGS. 2 to 6 as comprising a length of tubular stock having parallel side faces 23. Above the side faces, the relatively narrow and integrally formed support 14 provides the base frame with clearance spaces 24. Near each end edge 25 of the base frame, the side faces 23 are provided with positioning pins 26 which are threaded into suitable openings formed in the frame 12 so as to project a short distance laterally beyond the side faces 23.

The present jig is designed for use in forming dovetail joint members which allow the ends of the boards or the like to be joined together as part of a carcase for example. Two such boards are designated as 30 and 31 in the drawings where these workpieces are shown positioned to stand upright and bear against the opposite side faces 23 of the base frame. In this cutting position, the upper edges of the workpieces are about level with the top edge of the support 14 and preferably one side edge of each board is in contact with the aligned positioning pins 26 located near the left end edge 25 (FIG. 3) of the base frame.

Figure 4:
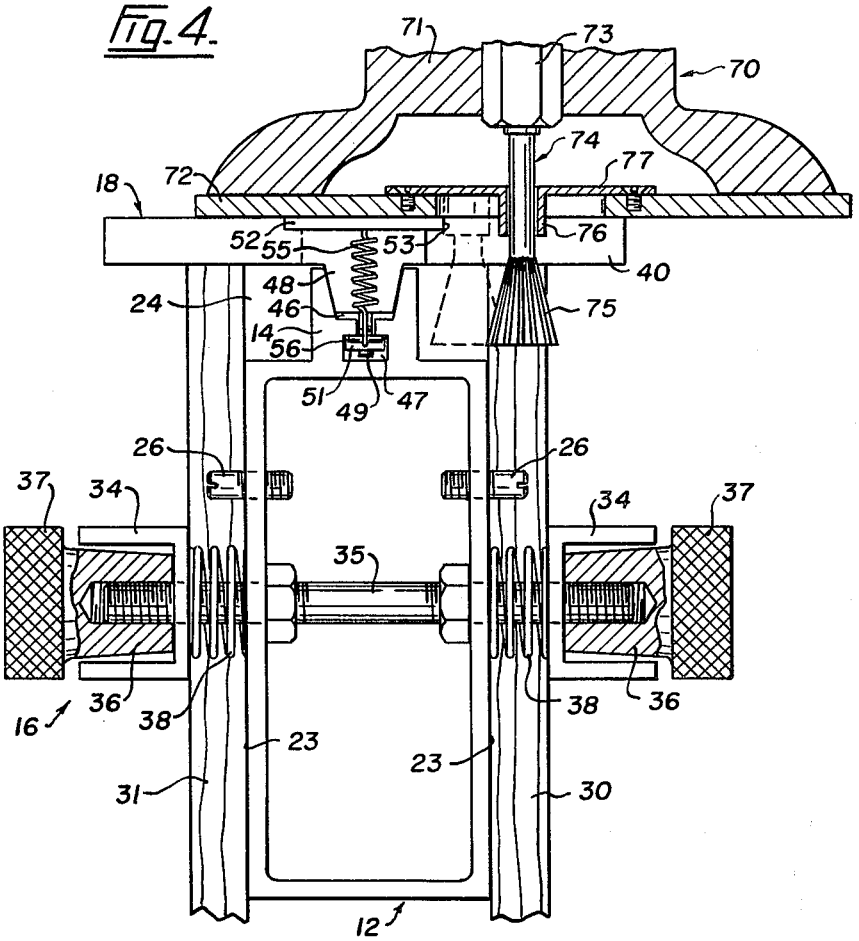
FIG. 4 is an enlarged end elevation of the jig mainly in section and showing a conventional power tool in a first cutting position on the jig.

The boards are held in the above described cutting position by the clamping means generally indicated at 16, which means is shown to comprise a pair of clamping bars 34 of approximately the same length as the base frame. These clamping bars 34, see particularly FIG. 4, are lengths of channel secured to the base frame by transverse bolts 35 located one near each opposite end edge 25 of the frame. Fitted to the laterally projecting ends of the bolts 35, are nuts 36 which preferably have knurled or otherwise shaped turning knobs 37. The cylindrical nuts enter between the flanges of the bars 34 and bear against the webs of those bars. Desirably, compression springs 38 are fitted to the bolts between the faces 23 of the base frame and the clamping bars 34 so as normally to urge those two bars outwardly of the frame 12. The simplified clamping means 16 serves to secure the base frame between the two boards and to hold the workpieces firmly while cutting is done along the upper edges of the boards.

Figure 2:
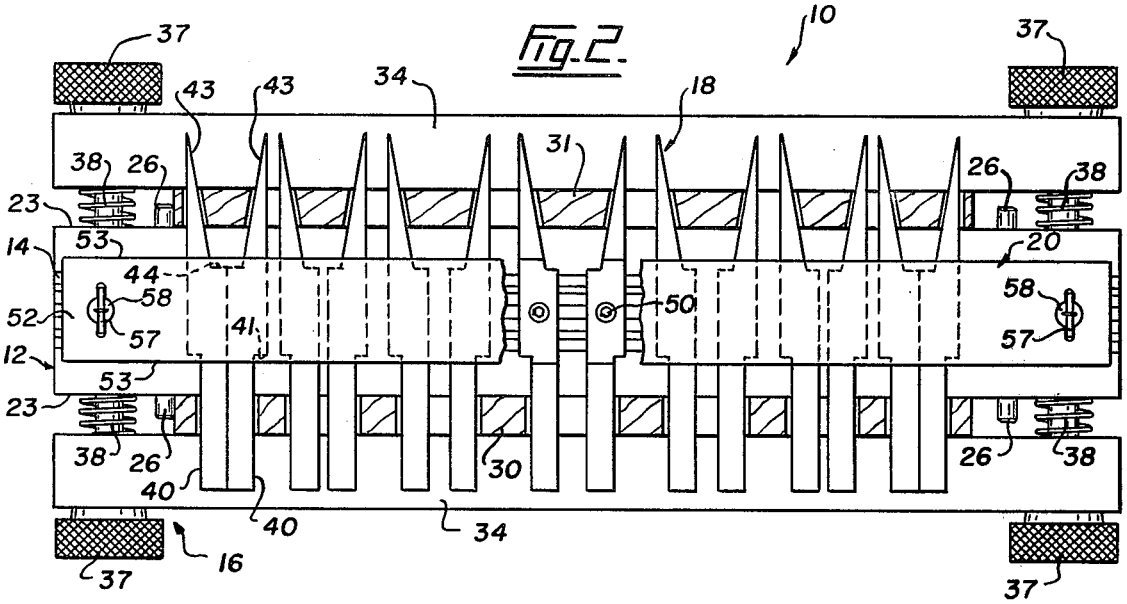
FIG. 2 is a plan view of the jig with parts broken away.

The transversely extending guide fingers generally indicated at 18 are adapted to be arranged in pairs as best shown in FIG. 2 where the opposite ends of the fingers which are reduced in width from center portions of the fingers, will be seen to project a short distance beyond the side faces 23 of the base frame. The opposite ends of each pair of fingers overhanging one side of the frame 12 are shaped to provide guiding surfaces 40 which are parallel to one another. Stops 41 are provided by the center portions at the inner ends of the surfaces 40, the aligned stops being disposed at right angles to those surfaces. Along the other side of the base frame, the opposite ends of each pair of fingers are shaped to provide inwardly converging guiding surfaces 43. The angled surfaces 43 terminate in stops 44 which are aligned with one another and therefore parallel to the stops 41 as well as to the longitudinal axis of the base frame.

Figure 5:
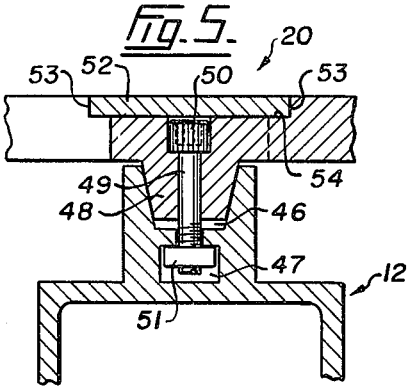
FIG. 5 is a further enlarged detail section showing means on the jig for securing guide fingers in selected positions.

Each guide finger 18 is separately secured to the support 14 by the means which has been generally indicated at 20. As best shown in FIG. 5, the securing means 20 comprises an inwardly tapering groove 46 which is formed in the upper edge of the support 14 to extend between the end edges 25 of the base frame. An inverted T-shaped passageway 47 is also formed in the support to connect with the bottom of the groove 46. The guide fingers are each provided below their center portions with a depending boss 48 which is tapered in the same manner as the groove so that a wedging action is achieved. A capscrew 49 extends through the center of each finger and the threaded lower end of this fastener projects into the passageway 47. The capscrews 49 each have a socketed head 50 which is enterable from the top of the finger and the bolt is fitted with a square nut 51 which is slidably but nonrotatably received in the passageway 47. Thus, the fingers 18 are supported parallel to one another with the guiding surfaces 40 at right angles to the longitudinal axis of the base frame 12. The fingers are independently movable along the support when their capscrews 49 are slacked off a few turns and each finger can be secured in a selected position by tightening the capscrew by a tool applied to the head 50. Since the tapered boss 48 is lodged in a correspondingly tapered groove 47, the securing means 20 will be seen to provide means for locating and maintaining each guide finger with the longitudinal axis of the finger at right angles to the corresponding axis of the base frame.

The uppermost edges of the plurality of guide fingers lie in a common horizontal plane and it is along the supporting surface provided by these edges that a powered cutting tool is moved during the formation of joint members in the boards held by the present jig. In order to span the spaces between the guide fingers, the jig 10 preferably is provided with a slide plate 52 having parallel side edges 53. The flat plate 52 is inset into recesses 54 formed in the fingers 18, the plate combining with the uppermost edges of the fingers to provide the required even surface for slidably supporting the cutting tool.

Figure 7:
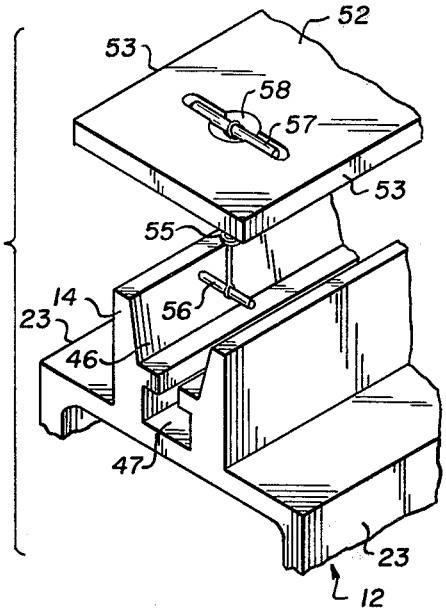
FIG. 7 is a perspective view showing a corner of a base frame and an end of a slide plate for the jig.

Slide plate 52 terminates short of the end edges 25 of the base frame and it is desirable that the terminal ends of the plate be secured in some manner to the frame 12. One such arrangement is shown best in FIG. 7 to comprise a spring 55 which is fitted at opposite ends with a latch pin 56 and a toggle 57. A recessed opening 58 is formed in the upper face of the plate to house the toggle. A similar fastening arrangement, not shown, is provided at the other end of the slide plate so that the plate is releasably secured to the support 14 to extend over the guide fingers without projecting above the uppermost edges of those fingers.

Figure 3:
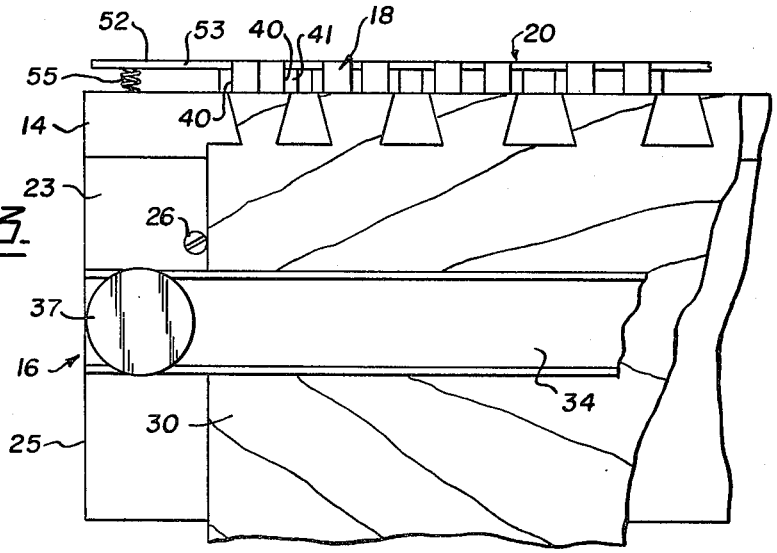
FIG. 3 is a side elevation of a corner of the jig.
Figure 8:
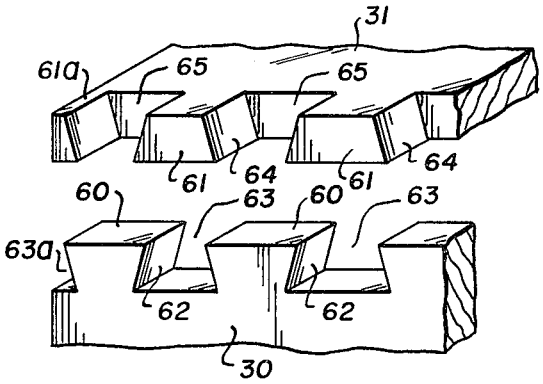
FIG. 8 is a perspective view of a typical dovetail joint which can be formed using the jig to support and guide the tool.

The guide fingers 18 will allow the cutting of the joint members of a through dovetail joint in the upper edges of the workpieces 30 and 31. FIG. 8 shows the members which are adapted to interlock and form such a joint, the members 60 being commonly referred to as dovetails and the members 61 being known as pins. The dovetails 60, which have inclined side edges 62, are separated by tapered sockets 63 in which the tapered pins 61 are adapted to be lodged. Of course, the pins 61 have correspondingly inclined side edges 64 and sockets 65 intended to receive the dovetails. In FIGS. 2, 3 and 4, the present jig is shown set up so that the board 30 will be provided with the dovetail 60 and the board 31 will have the pins 61. The spacing between the dovetails, for example, and the size of those particular joint members are often deliberately varied to enhance the appearance of the finished joint. A woodworker may decide that the center dovetail should be the largest and that the dovetails should progressively diminish in size and spacing from the center to the end edges of the board. The guide fingers 18 are then arranged as shown best in FIG. 2, that is, they are spaced apart so that the central pair of fingers can be used to cut the largest dovetail and pin and so that the pairs of guide fingers at the outer edges of the boards can be used to cut the smallest pins and dovetails. The finger arrangement must also make provision for half pins **61*a* of suitable proportion to be formed at each opposite end edge of the board 31 and so that the corresponding side edges of the board 30 will have half sockets 63*a*** to receive those half pins.

Figure 6:
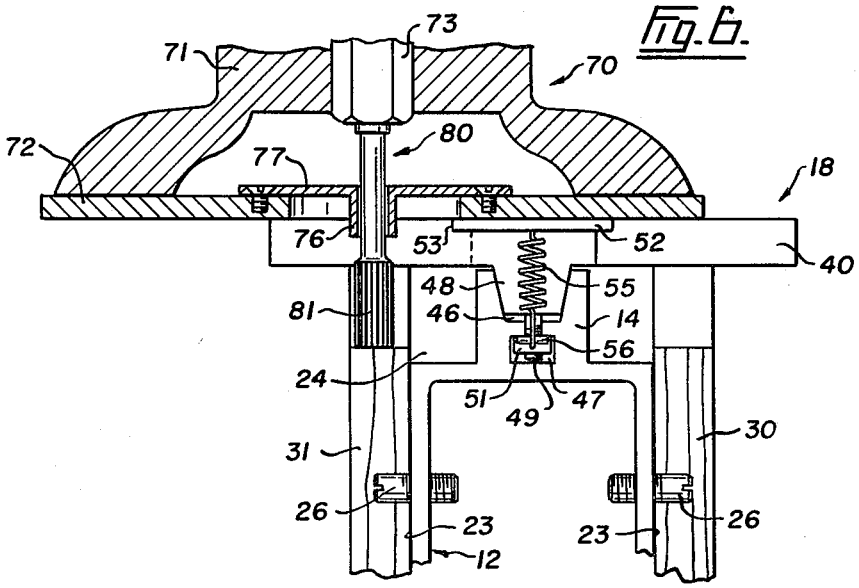
FIG. 6 is an end elevation of an upper portion of the jig showing the power tool in a second cutting position on the jig.

The dovetails and pins are cut by a router 70 such as the one shown in FIGS. 4 and 6, this conventional power tool having a motor 71 mounted on an annular base 72. A drive chuck 73 of the motor is fitted with a conventional dovetail bit 74 which has a tapered cutting head 75. The cutter bit of this type of router normally projects through a template guide or sleeve 76 which depends below a circular disc 77 secured to the top surface of the base plate. Such a sleeve guide, of course, prevents the rapidly rotating cutter bit from coming into contact with any of the guiding surfaces of the fingers 18. It will be noted that the dovetail bit 74 is fitted to the chuck so that it will project down into the end edge of the board 30 by the thickness of the board 31 plus a small allowance for clean up which is done when the two boards are united by the dovetail joints.

The boards 30 and 31 are prepared for dovetailing by having their end edges squared up as usual whereupon they are clamped to the base frame 12 by the means 16. As previously mentioned, the upright boards normally have one side edge placed against the positioning pins 26 near the left end of the base frame although the side edges may be offset a selected distance from those pins for some special design considerations. The assembly is held firmly, for example, by temporarily securing it to a work bench using the available bench vice and the dovetailing can then commence. With the slide plate 52 removed from the jig, the woodworker arranges the guide fingers 18 along the support 14 to obtain the desired spacing and then locks the fingers in their adjusted positions using the securing means 20 before replacing the slide plate. The undersides of the opposite ends of the fingers can be in sliding contact with the upper edges of the boards as this adjustment is made and most woodworkers find it easier to visualize the finished layout of pins and tails by viewing downward on the angled guiding surfaces 43. It is matter of choice whether the tails or the pins are cut first.

In operation, and assuming the tails are to be cut first, the router 70 is placed on the top surface of the guide fingers 18. The coplanar surfaces of the guide fingers and the slide plate 52 then support the router in a position to be moved as required to do the dovetailing. The woodworker slides the router along the top of the guide fingers and also moves the tool laterally so that the bit 74 travels towards and away from the longitudinal axis of the base frame. At this time, the sleeve guide 76 is held in contact first with one bearing surface 40 and then with an adjacent bearing surface to move the cutter bit through the wood. The cutting head 75 enters one of the clearance spaces 24 at the completion of each cross cut and the guide sleeve 76 contacts the adjacent side edge 53 of the slide plate to prevent the cutting head from touching the side of the support 14. This cutting actually removes the wood which forms the sockets 63 and half sockets **63*a* and thereby shapes the dovetails 60** leaving them standing clear of the remainder of the board.

The finger adjustment which was made for the jig prior to the start of the cutting operation remains unchanged, in other words, no additional adjustment is required and the woodworker merely has to remove the dovetailing bit 74 from the router and replace it with a cutter bit 80 which is shown in FIG. 6 to have a straight cutting head 81. This bit is fitted to the chuck 73 so that it will project down into the board 31 by the thickness of the board 30 plus a small allowance for clean up as before. The router is now placed on the guide fingers 18 so that the sleeve guide 76 slidably engages the angled guiding surfaces 43 thereby allowing the pins 61 to be cut on the board 31. Put another way, wood is removed from the second board to leave the pins 61 and half pins **61*a* projecting above the remainder of the workpiece. It should be noted that the inclined surfaces 64 on the pins are disposed at an angle which corresponds to the inclination on the side edges 62 of the dovetails which were formed by the dovetail bit. Thus, the pins which are cut by the straight bit 70 are inclined at the same angle as the dovetails cut by the bit with the tapered head 75. The sleeve guide 76 is moved in sliding engagement with the guiding surfaces 43 as this cutting action is done and the adjacent side edge 53 of the slide plate halts inward movement of the cutter bar beyond the clearance space 24. The end result is that the second board 31 is provided with the pins 61 and half pins 61*a* which will interlock with the dovetails, sockets and half sockets previously cut on the board 30**.

It will be apparent that the sleeve guide 76 coming into contact with the slide plate 52 normally is relied upon to limit inward movement of the cutting tool. The guide fingers which make up each pair of fingers can be widely spaced apart as previously explained and therefore it is possible a gap will exist between some pairs of fingers which would allow entry of the sleeve guide between those fingers were it not for the plate 52. The slide plate, however, spans the spaces between the fingers and the sleeve guide 76 comes into contact with a side edge 53 of the slide plate if that overlarge spacing should exist. The side edges of the plate 52 always halt the cutter bits within the clearance spaces 24 regardless of the transverse spacing between the guide fingers. In some types of cutting other than the one described above, the slide plate 52 might not be installed in which case the stops 41 and 44 prevent the cutter bits from coming into contact with the support.

Figure 10:
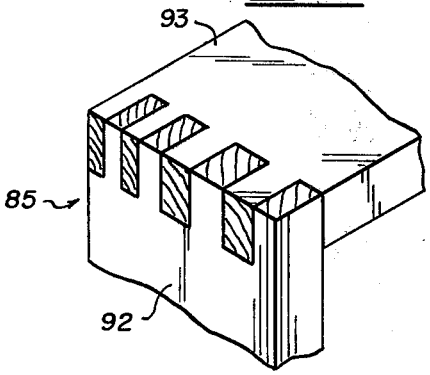
FIG. 10 is a perspective view of such a box corner joint.
Figure 9:
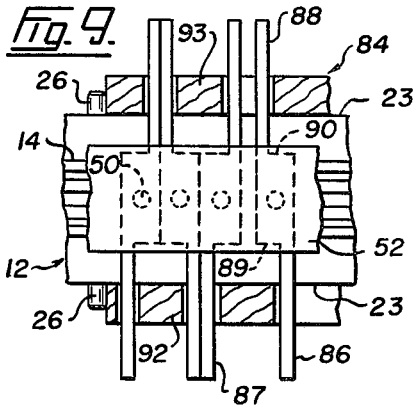
FIG. 9 is a fragmentary plan view of another embodiment of the invention used to cut box corner joints.

The jig 10 is described above as it is constructed and used to cut a conventional through dovetail joint but it will be apparent the same device or at least a slightly modified version of such a jig will enable other interlocking corner joints to be cut as well. There are a great many joints known to woodworking craftsman likely to use the present invention and by proper adjustment of the appropriate jig or associated parts a variety of joint members can be cut. In FIG. 9, there is shown another embodiment of the present invention which comprises a modified jig 84 of the type used to form a box corner joint 85 such as is shown in FIG. 10. The jig 84 has parts corresponding to those of the jig 10 and therefore designated by the same reference numerals but this modified jig is provided with guide fingers 86. The opposite ends of the fingers 86 are shaped into parallel guiding surfaces 87 and 88. The surfaces 87 of each pair of fingers 86 oppose one another and terminate and their inner ends in stops 89. Other stops 90 are provided for the surfaces 88, these guiding surfaces being formed on opposite sides of each pair of fingers. A slide plate 52 is inset into the top surfaces of fingers 86 to limit inward movement of the cutting tool as previously described.

The router 70 fitted with a straight bit 80 is used on the jig 84 to cut the pins in the ends of boards 92 and 93 which are interconnected by the joint 85. As before, the transverse spacing between the guide fingers 86 can be varied if desired to give the varied pin arrangement illustrated in FIG. 10. The router is placed in sliding contact with the slide plate 52 and the top of the fingers 86 and the guide sleeve 76 is applied to the surfaces 87 as the bit is moved through its cutting strokes. The board 92 is cut to provide the sockets and pins whereupon the board 93 is shaped by the same router bit to provide corresponding joint members. The pin and socket arrangement thus formed can be interlaced to form the joint 85.

Figure 11:
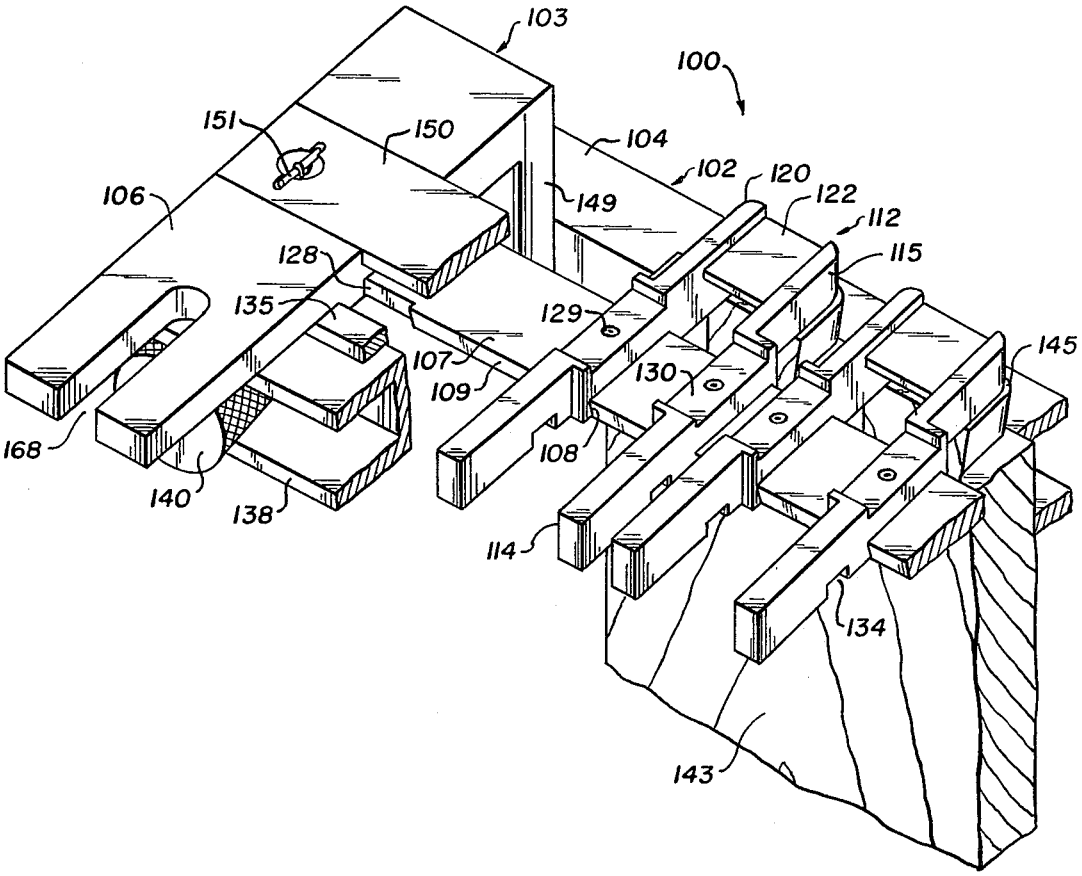
FIG. 11 is a perspective view of still another embodiment of the invention showing a jig for cutting flush or half blind dovetails.
Figure 12:
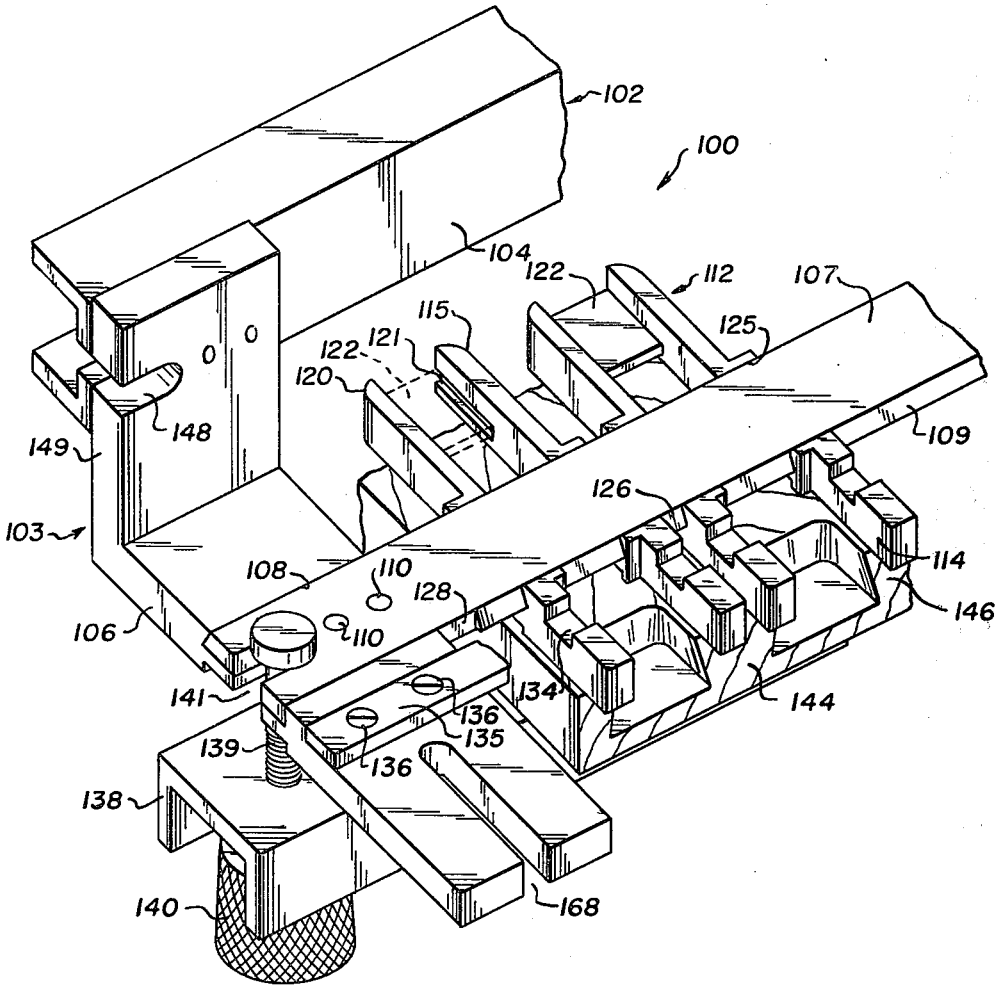
FIG. 12 is a perspective view of the jig as used to cut the pins of a flush or half blind dovetail joint.

Referring now to the embodiment shown in FIGS. 11 and 12, the numeral 100 indicates generally a jig designed for use in cutting flush or half blind dovetails. The jig 100 comprises a base frame 102 having identical end brackets 103 which are connected together by a longitudinal member 104. Each of the L-shaped end brackets has a normally horizontal leg 106. These legs are interconnected by a bar-like support 107 and the opposite ends of the support are set into recesses 108 provided in the top surfaces of the bracket legs. The flattened support 107, which has tapered side edges 109, is secured to the bracket legs 106 by screws 110.

A plurality of guide fingers 112 are carried by the support 107 between the end brackets. These fingers are arranged in pairs and the fingers of each pair have parallel guiding surfaces 114 and 115 at their opposite ends. The guiding surfaces 114 are opposed to one another while the guiding surfaces 115 are formed on opposite sides of the two fingers making up each pair. Each finger has a rounded end 120 which merges with the surface 115. The opposing faces of each pair of fingers are provided with grooves 121 which extend only a short distance longitudinally of the fingers. An insert 122 is adapted to be fitted to the grooves 121 of each pair of fingers so as to be frictionally held therein. These removable inserts are cut, preferably by the user of the jig 100, from a length of material supplied with the jig so as to fit into the grooves between the pairs of fingers and it will be apparent the length of each insert is determined by the selected spacing between each pair of fingers.

As shown best in FIG. 12 a transverse groove 125 is provided in each finger 112 and this groove has tapered side edges 126 which conform to the taper on the side edges 109 of the support 107. Thus, the fingers are mounted for sliding movement along the support and are held by the tapered edges 109 and 126 against falling below the support. More importantly, the fingers are kept at all times at right angles to the longitudinal axis of the support 107. It will be noted the support is provided near the opposite end brackets with loading slots 128 which are cut into the tapered side edges 109. These slots 128 allow the fingers to be loaded one at a time onto the support and then moved along the support to make room for the next finger. The support 107 is loaded with the required number of fingers in this manner and each finger is secured against sliding movement along the support by a set screw 129, see FIG. 11 only. The head of each set screw 129 is located centrally of another transverse groove 130, see FIG. 11, formed in each finger. When the screws are tightened, the tips of the screws are pressed against the adjoining face of the support and this forces the tapered edges 109 and 126 together and locks the fingers in their selected positions with the guiding surfaces precisely at right angles to the longitudinal axis of the support.

The ends of the fingers 112 which have the guiding surfaces 114 are also provided with transverse notches 134. These notches are aligned to receive a stop bar 135 which is thus supported with its top surface (FIG. 12) flush with the corresponding surfaces of both the support 107 and the fingers. The opposing ends of the stop bar are fastened by means of screws 136 to the horizontal legs of the end brackets 103, the ends of the legs being reduced in thickness to accommodate the stop bar ends.

The jig 100 is provided with workpiece clamping means which preferably comprise a single channel-like clamping bar 138. At each end of the bar 138, an endwise movable bolt 139 is carried by the bar and this bolt is fitted with a knurled nut 140. The normally horizontal legs 106 of the end brackets and the connected ends of the support 107 are provided with inwardly-extending slots 141 to receive the shanks of the bolts 139. The heads of the bolts sit on the support in the FIG. 12 arrangement with the shanks of the bolt projecting through the slots 141 hold the clamping bar 138 spaced below the support bar in a position to clamp and hold a workpiece.

Figure 13:
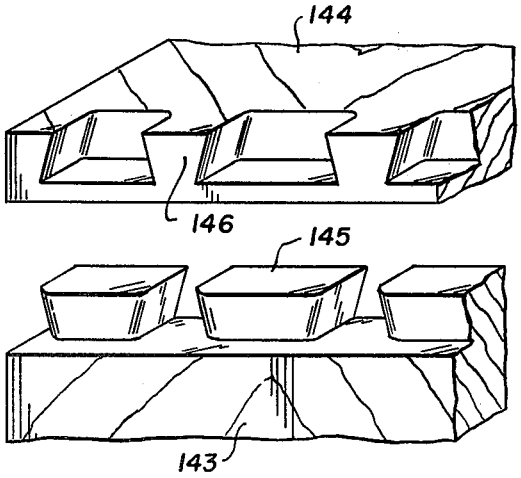
FIG. 13 is a perspective view showing such a joint.

FIG. 13 shows a typical half blind dovetail joint which can readily be formed using the jig 100. The joint serves to interconnect boards 143 and 144 by means of dovetails 145 and pins 146 which must be formed in the end edges of the two boards. In order to cut away the wood which will form these joint members, the normal procedure is to first cut the dovetails 145 and therefore the jig 100 is used in the FIG. 11 position. With a required number of fingers 112 slidably mounted on the support 107, the workpiece 143 is placed against the frame member 104 the edge of the board which is to be cut is disposed against the undersides of the fingers. The clamping bar 138 is placed against the board and the bolts 139 are projected through slots 148 (FIG. 12) formed in legs 149 of the end brackets as well as in opposite ends of the frame member 104. Once the vertically disposed board is properly positioned in the jig, the nuts 140 are tightened to hold the workpiece in cutting position. The user of the present jig decides what sort of arrangement would be best for the joint members, that is; their size, spacing, distance from the end edges of the board and so on and adjusts the transverse spacing of the guide fingers accordingly. Once the fingers have been suitably arranged in pairs along the support 107, the fingers are locked in their selected positions by their set screws 129. A slide bar 150, see FIG. 11, is then entered into the recesses 130 and is held by a fastening devices 151 one of which is generally indicated at 151 in FIG. 11. The devices 151 extend through the slots 141 to hold the slide bar in position.

The vertical workpiece 143 and horizontal jig 100 are held steady in some suitable manner near the top of a work bench or elsewhere and the router 70 is then applied to the work. The router at this time is fitted with the bit 74 which has the tapered cutting head 75. The bit is adjusted to cut to a depth required to remove sufficient wood from the end edge of the board which will leave the dovetails 145 upstanding. To do this, the base of the tool is placed on top of the slide bar 150 so as to be able to slide along that bar as well as the fingers 112. The sleeve guide 76 is moved in sliding engagement with the guiding surfaces 115 and the outer edges of the inserts 122 as the pins are cut. Because the sleeve guide 76 is cylindrical and the fingers have the rounded corners 120, two of the four corners of the dovetails are rounded as well.

The board 143 is now removed from the jig 100 and so is the clamping bar 138 which is required elsewhere for the cutting of the board 144. Care is taken at this time not to disturb the setting of the guide fingers 112 on the support and the base frame 102 is inverted and turned end to end to the position shown in FIG. 12. The board 144 is positioned horizontally so that the surface to be cut bears against the undersides of the guide fingers in the vicinity of the surfaces 114. Once the board is correctly positioned relative to the guiding surfaces and the outer edge of the stop bar 135, the workpiece is clamped in the cutting position using the same clamping bar 138. The bolts 139 are projected through the slots 141 with the clamping bar 138 bearing against the underside of the board so that the workpiece is clamped in the desired cutting position when the knurled nuts 140 are tightened on their bolts.

The horizontal workpiece 144 with jig 100 in the FIG. 12 position attached thereto is held steady and the cutting is done again with the router fitted with the same dovetail bit 74. The depth of cut of the bit is not altered at this time, that is, the same depth is used to cut the pins 146 as was used to form the tails 145 in the first workpiece. The router base is placed in sliding contact with the coplanar top surfaces of the support 107, the stop bar 135, and the guide fingers 112 while the sleeve guide 76 is applied to one of the surfaces 114. By sliding the sleeve guide along one guiding surface, across the outer edge of the stop bar 135, and then along the other guiding surface of each pair of fingers, the top surface of the board at the end edge has the right amount of wood removed to provide the socket-like recesses which define the pins 146. Pins cut in this manner, of course, exactly match the tails 145 cut in the workpiece 143. The cylindrical sleeve 76 moving between the surfaces 114 and the outer edge of the stop bar serves to round off corners of the recesses to match corresponding corners of the tails 145. Since the same bit is used to cut the dovetails and pins, the taper on the joint members is the same as well and the resulting half blind dovetail joint is a snug fit when the two workpieces subsequently are joined together.

Figure 14:
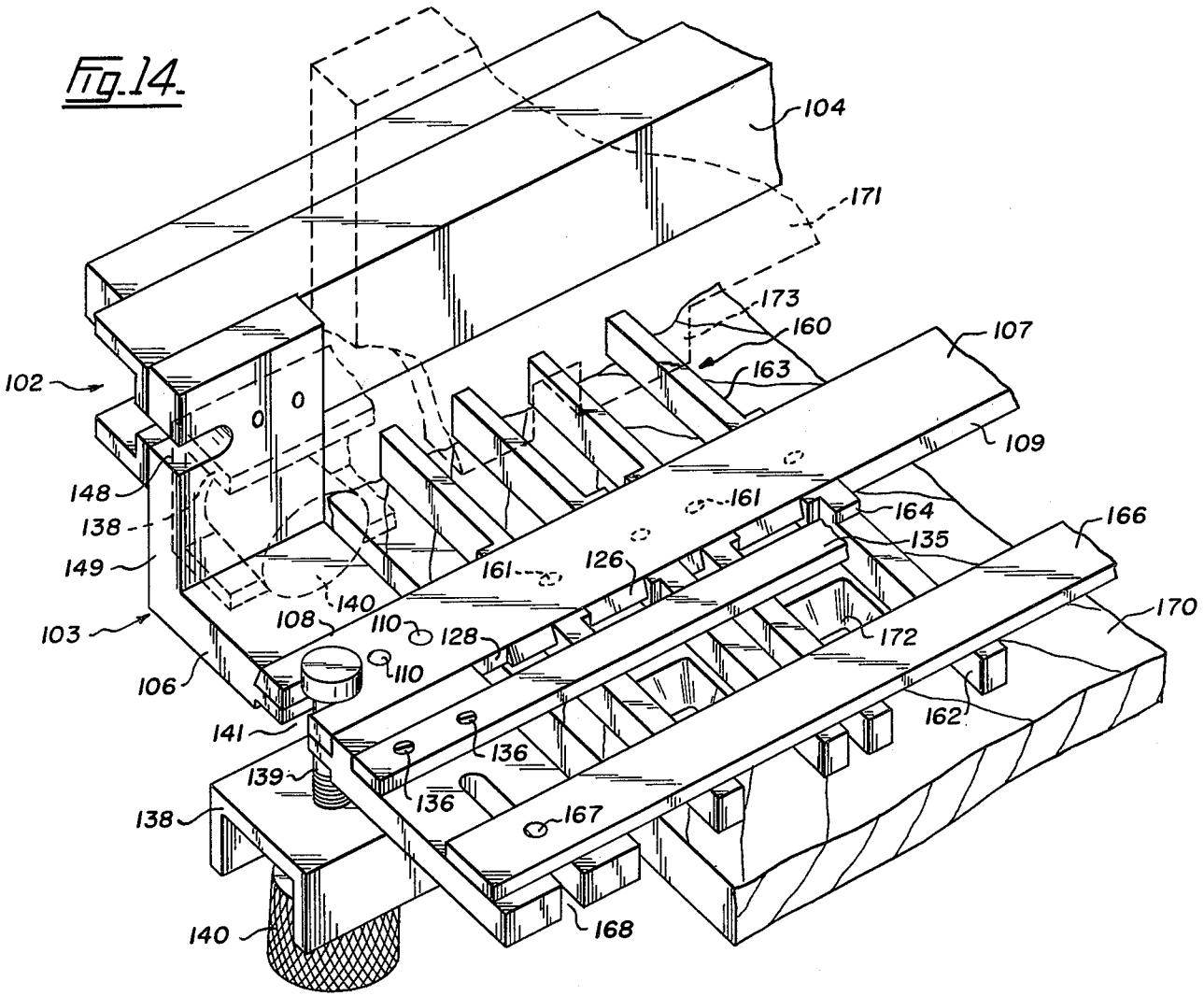
FIG. 14 is a perspective view of still another embodiment of the invention showing a jig used to cut multiple mortise and tenon joints.

Referring now to FIG. 14, the base frame 102 is shown fitted with modified guide fingers 160 which are mounted on the support 107 as before and are secured by set screws 161. Fingers 160 have parallel guiding sufaces 162 and 163. The surfaces 162 oppose one another on each pair of fingers and, at these surfaces, the fingers are reduced in height to provide a recess 164 in which the stop bar 135 is seated. Also seated in this recess is a control bar 166 which is spaced from and normally extends parallel to the bar 135. The opposite ends of the control bar are each fitted with a bolt 167 which projects downwardly through a slot 168 formed in the extreme end of the leg 106 of the end bracket. A nut (not shown) is fitted to the lower end of each bolt 167 so that the control bar can be spaced a selected distance from the stop bar 135 and be secured in that position.

The foregoing arrangement provides a jig which is used to cut multiple mortise and tenon joints in workpieces 170 and 171 which is a particularly useful joint in carcase construction. To do so, sufficient pairs of the fingers 160 are mounted on the support 107 as previously described and are secured in the adjusted position by their set screws 161. The spacing between the parallel bars 135 and 166 is adjusted as required to form mortises 172 of a suitable depth in the workpiece 170. The board 170 is placed under the guide fingers and is positioned so that the line of the proposed mortises will be located the required distance from the adjacent end edge of the workpiece. The clamping bar 138 is used to hold the workpiece in this adjusted position. The router fitted with a straight sided bit 80 is used to cut the mortises and this is done by lowering the rotating cutter between the two bars 135 and 166 and the guiding surfaces 52 of each pair of fingers. The base of the router, of course, sits on the support 107 as well as the bars 135 and 166 the top surfaces of which are all in the same horizontal plane. The sleeve guide 76 is brought to bear against the opposing sides of the bars and the guiding surfaces as the hole initially made by the cutter is widened to form each mortise.

When all the mortises have been cut preferably in the above described manner, the board 170 is removed from the jig and the workpiece 171 is installed in cutting position. This position is shown by dotted lines in FIG. 14 with the board standing vertically against the frame member 104 and the end edge of the workpiece in which tenons 173 are to be cut resting on the guide fingers 160. The workpiece is carefully adjusted in this position and is held by the clamping bar 138, the bolts 139 then projecting through the slots 148 in the end brackets. When the assembly is inverted and is secured against movement by being held by a bench vise for example, the router is placed on top of the guide fingers 160 and on the slide bar 150 which is used with such fingers. The straight cutter bit 80 projects below the opposite guiding surfaces 163 of a pair of guide fingers and the sleeve guide 76 slides in contact with those surfaces as a tenon 173 is cut. All the tenons so cut will match the previously cut mortises except that the corners of the tenons will be square while the corners of the mortises are rounded. This makes it necessary to round the corners of the tenons when the workpiece has been removed from the jig, the rounding being done by hand using a chisel or a rasp to achieve the final fit. It will be apparent the jig 100 can be used to cut single mortise and tenons in boards intended for use in frame construction.

From the foregoing, it will be apparent the present invention provides a simply constructed and relatively inexpensive device which will greatly facilitate the cutting of various kinds of interlocking corner joints. The cutting is done with a conventional router which most amateur carpenters and hobbyists have amongst their equipment. Since the guide fingers are adjustable, the user can select a size and spacing for the joint members which will best suit the boards he is working with and the aesthetic design considerations he is trying to achieve.

I claim:

1. A jig for supporting and guiding a power tool used to cut joint members in workpieces, comprising:

a base frame having a support, a plurality of guide fingers extending across the support with opposite ends of the fingers projecting beyond side edges of the support, said guide fingers having guiding surfaces for the power tool on their opposite ends, securing means adjustably securing each guide finger to the support for movement longitudinally of the base frame whereby the spacing between adjacent fingers and their guiding surfaces is selectively variable, and clamping means for securing workpieces to the base frame each in a position to be cut by the power tool supported on the guide fingers and guided by the guiding surfaces to provide joint members in one workpiece and complementary joint members in another workpiece.

2. A jig as claimed in claim 1, in which said guide fingers are provided with means at the inner ends of the guiding surfaces for limiting inward movement of the power tool.

3. A jig as claimed in claim 1, in which said securing means includes locating means for maintaining each guide finger with the longitudinal axis of the finger at right angles to the corresponding axis of the base frame.

4. A jig as claimed in claim 1, in which said guide fingers have coplanar upper surfaces on which the power tool is slidably supported with a cutter bit of the tool depending below the guiding surfaces.

5. A jig as claimed in claim 4, and including a slide plate mounted on the upper surfaces of the guide fingers to be coplanar therewith and extend longitudinally of the support, said slide plate having side edges limiting entry of the cutter bit between the guide fingers.

6. A jig as claimed in claim 4, in which said base frame has opposite side faces, said support extending longitudinally of the base frame and being spaced inwardly of the opposite side faces to provide clearance spaces enterable by the cutter bit of the power tool.

7. A jig as claimed in claim 6, in which said opposite side faces are each provided with a laterally projecting positioning member engageable by a side edge of a workpiece.

8. A dovetailing jig for supporting and guiding a power tool fitted with a depending cutter bit comprising;

a base frame having opposite side faces, an elongated support extending longitudinally of the base frame and spaced from the opposite side faces to provide clearance spaces, a plurality of guide fingers mounted on the support, said guide fingers having opposite ends projecting over the clearance spaces and the opposite side faces of the base frame, said opposite ends being shaped to provide guiding surfaces engageable by a part of the power tool, securing means adjustably securing each guide finger to support whereby the transverse spacing between adjacent fingers is selectively variable, and clamping means for securing workpieces to the side faces of the base frame with end edges of the workpieces disposed in cutting positions relative to adjacent guiding surfaces whereby the power tool when slidably supported above the guide fingers and directed by the guiding surfaces is operable initially to cut joint members in the end edge of one workpiece and subsequently to cut complementary joint members in the end edge of another workpiece.

9. A jig as claimed in claim 1, in which said base frame is provided with end brackets, said support extending longitudinally of the base frame between the end brackets, an inner stop bar carried by the end brackets spaced a predetermined distance from and extending parallel to the longitudinal axis of the support for limiting inward cutting movement of the power tool.

10. A jig as claimed in claim 9, and including an outer stop bar carried by the end brackets spaced a predetermined distance from the inner stop bar to limit outward cutting movement of the power tool.

11. A jig as claimed in claim 9, in which said guide fingers are arranged on the support in pairs, each of said pair of guide fingers having opposing grooves formed in opposite ends thereof remote from the inner stop bar, and a guiding insert mountable in the opposing grooves of each pair of guide fingers to bridge the space between said fingers and interconnect adjacent guiding surfaces.

12. A dovetailing jig for supporting and guiding a power tool fitted with a depending cutter bit, said jig comprising a base frame having end brackets connected by a longitudinal frame member, said end brackets each having a vertical leg and a horizontal leg, a support extending between the horizontal legs, a plurality of guide fingers arranged in pairs along the support to extend transversely thereof, said pairs of guide fingers each having opposite ends projecting beyond side edges of the support and being shaped to provide guiding surfaces corresponding to complementary joint members, securing means for fastening each guide finger to the support whereby the transverse spacing between each pair of guide fingers and the transverse spacing between adjacent pairs of guide fingers are both selectively variable, and clamping means for securing a workpiece to the base frame in either a first or a second position, said first position disposing a workpiece parallel to the guide fingers and with an end edge thereof adjacent the guiding surfaces along one side edge of the support, said second position disposing a workpiece perpendicular to the guide fingers and with an end edge thereof adjacent the guiding surfaces along an opposite side edge of the support, said guide fingers underlying the power tool as the depending cutter bit is moved between the guiding surfaces to cut joint members in a workpiece in the first position and complementary joint members in a workpiece in the second position.

13. A dovetailing jig as claimed in claim 12, and including a guiding insert mountable between the opposite ends of each pair of guide fingers to provide a path of travel for the power tool when moved between adjoining guiding surfaces.

14. A dovetailing jig as claimed in claim 13, and including a slide plate inset into the guide fingers to extend longitudinally of the support, said slide plate having side edges limiting entry of the cutter bit between adjacent pairs of guide fingers.

* * * * *